US005261212A

United States Patent [19]

Debord

[11] Patent Number: 5,261,212

[45] Date of Patent: Nov. 16, 1993

[54] METHOD AND APPARATUS FOR ADJUSTABLY MOUNTING SADDLE STIRRUPS AND RIGGING

[76] Inventor: John R. Debord, P.O. Box 3, 1114 W. Gonzlaes, Yoakum, Tex. 77995

[21] Appl. No.: 3,268

[22] Filed: Jan. 11, 1993

[51] Int. Cl.[5] ..... B68C 1/16
[52] U.S. Cl. ..... 54/46.2
[58] Field of Search ..... 54/46.1, 46.2, 44.1

[56] References Cited

U.S. PATENT DOCUMENTS

| | | | |
|---|---|---|---|
| 34,044 | 12/1861 | Eagle | 54/46.2 |
| 1,321,398 | 11/1919 | Sievert | 54/44.3 |
| 4,473,992 | 10/1984 | Conger, III | 54/46.2 |
| 4,782,649 | 11/1988 | Zubrod | 54/46.2 |

FOREIGN PATENT DOCUMENTS

| | | | |
|---|---|---|---|
| 390794 | 10/1908 | France | 54/46.2 |

*Primary Examiner*—Robert P. Swiatek
*Attorney, Agent, or Firm*—Charles W. Hanor

[57] ABSTRACT

A hanger and method for adjusting the position of the stirrups on a riding saddle and the position of the saddle on a horse. The hanger has first and second generally horizontal and parallel bars extending longitudinally along the saddle tree from front to back for receiving a stirrup leather and fender or rigging strap and at least three adjusting pins slidably mounted on the second horizontal bar to slidably engage the first horizontal bar whereby the stirrup leather or rigging strap can be selectably positioned and retained at a selected longitudinal position relative to the saddle or saddle tree.

6 Claims, 2 Drawing Sheets

METHOD AND APPARATUS FOR ADJUSTABLY MOUNTING SADDLE STIRRUPS AND RIGGING

BACKGROUND OF THE INVENTION

1. Field of the Invention

This invention relates generally to the field of horse saddles. More particularly, it relates to an adjustable stirrup leather hanger for a saddle tree and an adjustable rigging plate for the saddle. It has been known in the past to provide adjustable saddles and saddle components. Examples of these are shown in the prior art discussed below in the description of the prior art. These adjustable means take various forms.

One typical adjustment mechanism includes the use of a plurality of openings spaced along the saddle tree. At least one version, such as that disclosed in U.S. Pat. No. 1,321,398 to H. A. Sievert, discloses the stirrups hung on a ring or loop mounted on the inner side of the pommel. The ring loop is wider than the width of the stirrup rigging strap. A small leather ring or washer may be put either behind or ahead of the rigging strap to adjust the position of the rigging strap and stirrup.

It is important that the adjusting means for the rigging straps be easily and securely attachable to the saddle tree. It is also important that the adjustment be exact and that the adjusting means firmly retain the rigging strap at a selected position.

It is necessary to have an adjusting device that is strong enough and secure enough so no slipping or breakage occurs to protect a rider and the horse. The device must also be easily adjustable.

It is an object of the invention to provide a rigging adjusting bracket for a saddle tree which can securely and easily connect a rigging strap to the saddle tree.

It is another object of the invention to provide a rigging adjustment means which securely holds the rigging strap in a selected position.

It is another to provide a rigging adjustment means that provides sufficient strength and rigidity to avoid breakage or slippage.

Other objects of the invention will be apparent from the following detailed description.

2. Description of the Prior Art

Applicant is aware of the following prior art patents.

U.S. Pat. No. 1,321,397 issued to H. A. Sievert discloses a horse saddle with multiple adjusting means. The adjusting means include means for adapting and adjusting the saddle to the back of an animal and for adjusting the saddle to the needs and requirements of different riders. It states it provides for a saddle which will automatically adjust itself to the form and contour of the animal's back, under conditions of motion or rest. It also provides means for adjusting the effective length of the saddle, namely the distance between the pommel and cantle, to suit different riders. It also shows pivotal connections in FIG. 6 for longitudinal adjustability of the pommel. The lugs 35 and the ears 34 are so spaced that the arch may be moved forwardly from the position shown in FIG. 6. Adjustment of the pommel arch longitudinally also causes adjustment of the stirrups longitudinally. The stirrups may also be longitudinally adjustable on the pommel arch by a plurality of rigging strap openings 42 spaced as shown in FIG. 1.

U.S. Pat. No. 1,321,398 also to H. A. Sievert also discloses an adjustable saddle. In particular, it shows in FIG. 1 an adjustment for the stirrup rigging straps 41. The stirrups may be hung on a ring or loop 60 mounted on the inner side of the pommel by member 62. Loop 60 may be longer than the width of the stirrup rigging strap 41. A small leather ring or washer 61 may be put either behind or ahead of the rigging strap so the position of the rigging strap and stirrup are thereby slightly adjusted without adjusting the pommel.

U.S. Pat. No. 2,418,103 issued to C. G. Wells discloses a stirrup hanger 15 which includes at least two positions 19 and 20 for selectively placing the rigging strap 21 which suspends the spurs. The adjusting bracket 15 is secured to the saddle tree through members 16 and 17.

U.S. Pat. No. 1,508,631 issued to L. P. Wellmann, Sr. discloses and adjustable saddle for racehorses and pole horses. As shown in FIG. 2, the sidebars 5 and 6 are connected to the bars 10 and 11 respectively by a plurality of equally spaced reinforcing or connecting rods or bars 13 which forms spaces 14 at the forward end of the truss bars 5 and 6 to which the rigging straps 15 of the stirrup 16 may be selectively attached. The height of the jockey determines at which position on the truss bars 5 and 6 that the stirrups should be attached. The stirrups may be adjusted so that the weight or pressure of the jockey as he rises from his seat is carried by the neck and shoulder blades of the horse.

U.S. Pat. No. 767,003 issued to H. W. Mason discloses a racing saddle with adjustable stirrup leathers 11. This is accomplished by a plurality of slots 12 in which the stirrup leathers 11 can be selectively placed longitudinally along the saddle tree.

U.S. Pat. No. 4,061 issued to R. Caldwell, U.S. Pat. No. 8,454 issued to J. C. F. Solomon, U.S. Pat. No. 827,506 issued to G. C. Cox, U.S. Pat. No. 2,027,851 issued to S. E. Worchester, U.S. Pat. No. 2,315,487 issued to E. Steele, and U.S. Pat. No. 3,044,234 issued to A. W. Baldwin generally disclose saddles, some of which have adjusting means.

SUMMARY OF THE INVENTION

An apparatus for adjusting the position of the stirrups on a riding saddle and the position of the saddle on a horse, comprising a saddle tree having hanger means for adjustably receiving a stirrup leather or rigging strap. The hanger means has first and second generally horizontal bars extending longitudinally along the saddle tree from front to back for receiving the stirrup leather or rigging strap. At least three adjusting pins slidably engage the first horizontal bar whereby the stirrup leather or rigging strap can be selectably positioned and retained at a selected longitudinal position relative to the saddle tree. The adjusting pins have openings at their upper ends for slidably receiving the first generally horizontal bar and retaining means at their lower ends for slidably receiving and retaining them with the second generally horizontal bar. The invention includes a method for adjusting the position of a rigging strap on a saddle having an adjustable rigging plate for adjustably receiving a rigging strap, comprising the steps of positioning the rigging strap on the first generally horizontal bar and slidably positioning the at least three adjusting pins on the second horizontal bar on said hanger means while retaining the pins on the first horizontal bar whereby the rigging strap can be selectably positioned and retained at a selected longitudinal position relative to the saddle tree.

DESCRIPTION OF THE PREFERRED EMBODIMENTS

Figure 1:
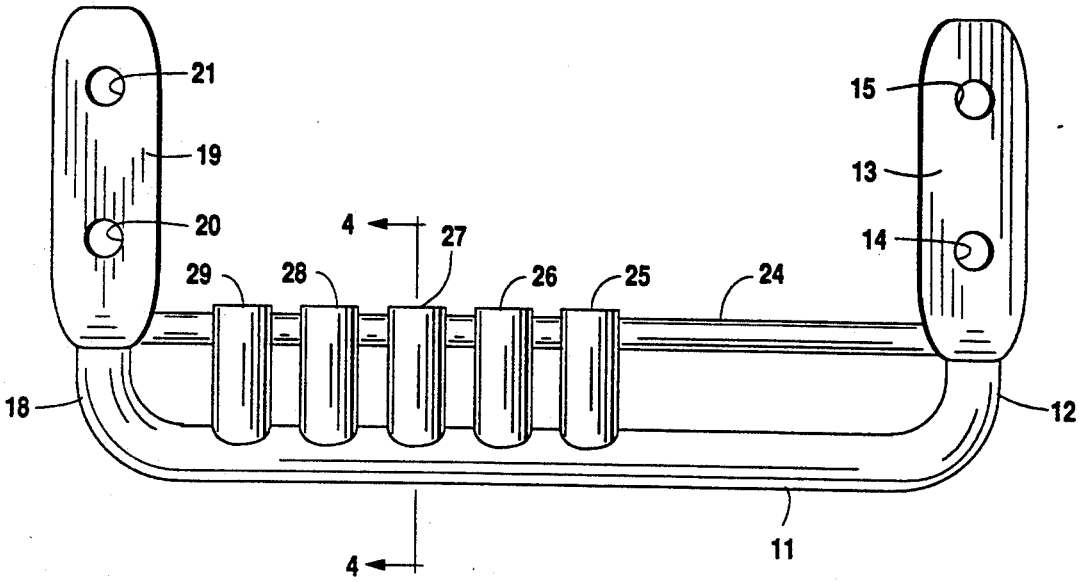
FIG. 1 is a side elevation view of the rigging strap adjusting bracket of the invention.

Referring to FIG. 1 of the drawings, there is shown a first embodiment of the rigging hanger 10. The hanger 10 includes a first generally horizontal bar 11 having a generally circular cross section. At its front, the bar 11 curves upwardly at portion 12 for connecting to flat bracket 13. The bracket 13 is used to attach the hanger 10 to the saddle tree T shown in FIG. 3. The bracket 13 includes a plurality of openings 14 and 15 through which screws or other connecting means 16 and 17 are used to connect it to the saddle tree T.

Figure 2:
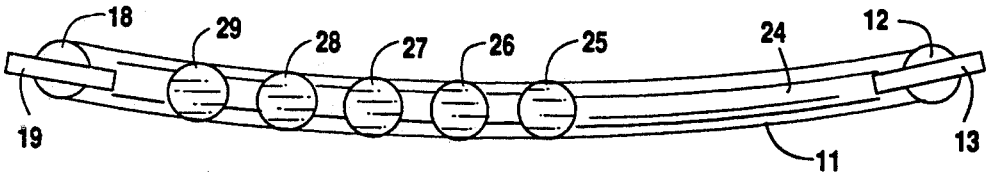
FIG. 2 is shows a top view looking down to FIG. 1.
Figure 3:
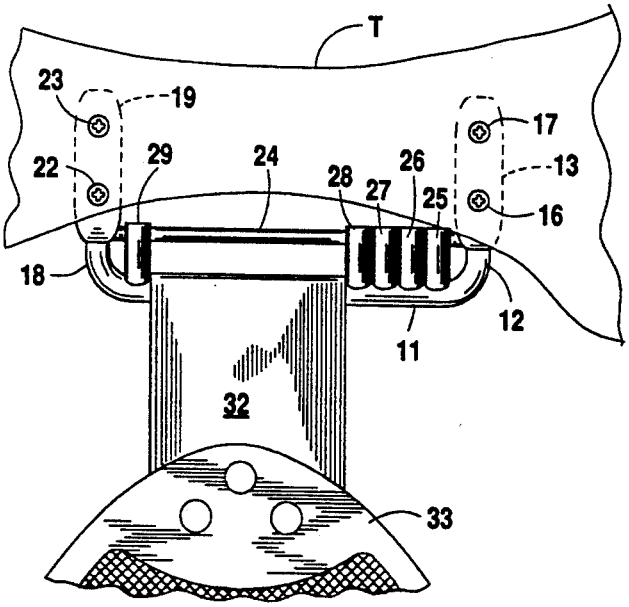
FIG. 3 shows the adjusting bracket attached to a saddle tree with a stirrup rigging strap in place.

The bar 11 curves upwardly at its rear end at portion 18 to where it is connected to another flat bracket 19 which is identical to the bracket 13. The bracket 19 includes openings 20 and 21 which are connected to saddle tree T as shown in FIG. 3 by screws 22 and 23. The brackets 13 and 19 are shown in the form of flat plates as shown in FIG. 2 for connecting to saddle tree T.

Figure 4:
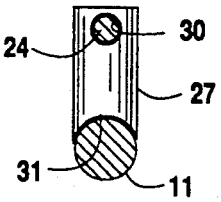
FIG. 4 shows a partial cross-sectional view along 4—4 in FIG. 1.

Again referring to FIG. 1, there is shown a second generally horizontal bar 24 having a generally circular cross section which is connected to the vertically extending portions of the first horizontal bar 11 and the brackets 13 and 19. Slidably mounted to the bar 24 are a plurality of pins 25, 26, 27, 28 and 29 having a generally circular cross section. As best shown in FIG. 4, each of the pins includes a round opening 28 and a curved recessed notch 31 at its lower end. The bar 24 extends through the opening 30 and the bar 11 fits closely to the inwardly recessed notch 31. This retains the pin 27 in contact with the bar 11 and allows it to be slidably positioned along bar 24 and bar 11 to a desired position. Pins 26, 27, 28 and 29 are identical so a detailed description is given of only one of the pins.

FIG. 3 of the invention shows a conventional stirrup leather or rigging strap 32 looped over and attached to bar 11. The stirrup leather or rigging strap 32 includes a widened portion or fender 33 for protecting a rider's leg from contact with the horse.

The operation and use of the hanger 10 is as follows. The rigging strap 32 loops over the top of bar 11 and is connected to the stirrup there below. When it is desired to change the position of the rigging strap 32 relative to saddle S, it is only necessary to remove rigging strap 32 from bar 11. Pins 25, 26, 27, 28 and 29 are then positioned at a desired location along the generally horizontal bars 11 and 24. The stirrup rigging strap 32 is then re-inserted in position in the space provided by positioning the pins to selected locations. This provides six possible positions for longitudinally adjusting the rigging strap in the form of stirrup leather or rigging 32 relative to saddle S. Strap 32 is rigidly held in place and cannot slide along bar 11. This retains rigging strap 32 in a selected position. The hanger 10 is typically constructed of metal material so that it is strong relative to the leather and saddle tree. The design of pins 25, 26, 27, 28 and 29 allows them to shifted along the bars 11 and 24 in six different positions.

Figure 5:
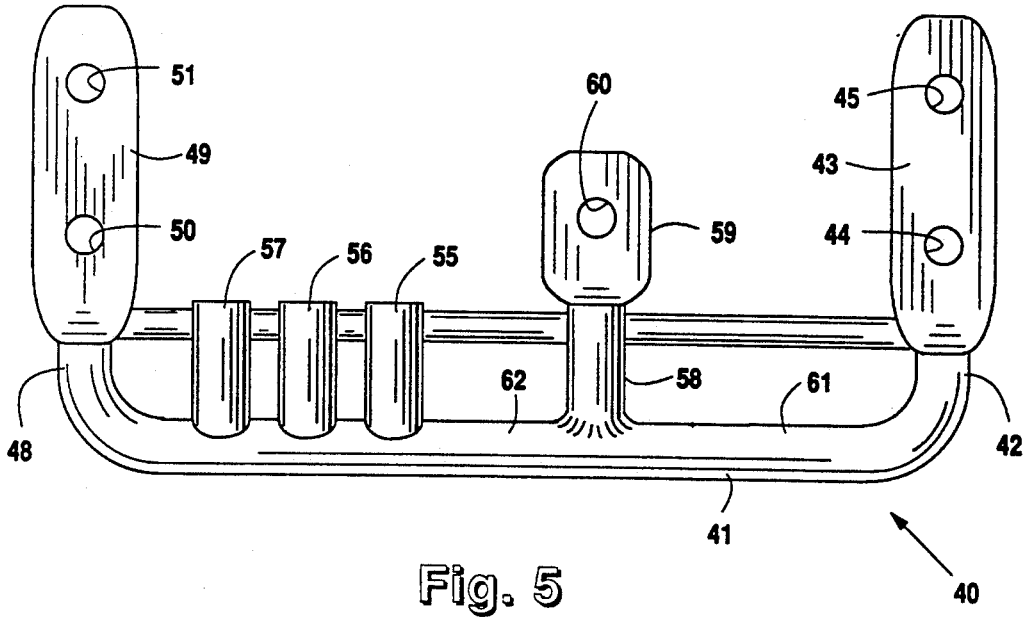
FIG. 5 shows a second embodiment of the invention for adjustably mounting the rigging on a saddle tree. (An adjustable rigging plate.)
Figure 6:
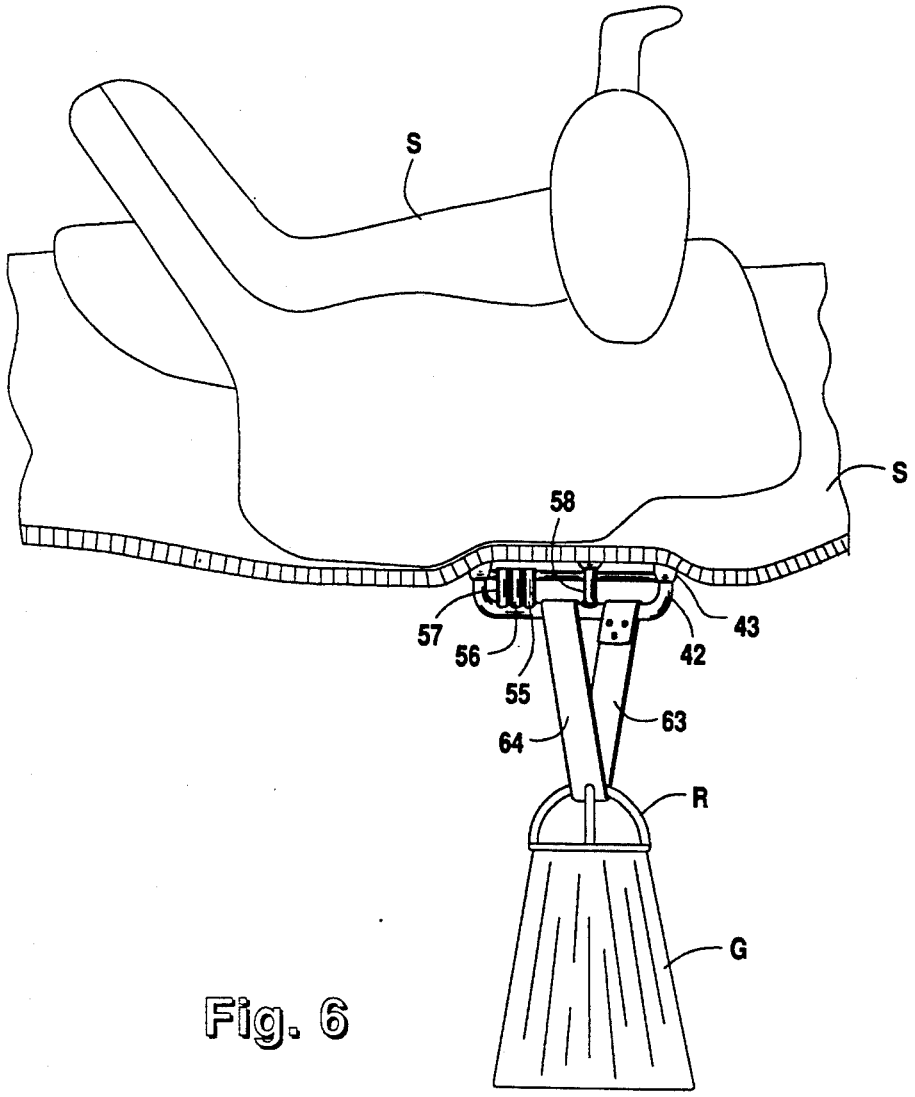
FIG. 6 shows the embodiment of FIG. 5 mounted on a saddle tree.

Another embodiment of the invention is shown in FIG. 5. FIGS. 5 and 6 show the invention adapted for conventional saddle rigging. The hanger 40 includes a first generally horizontal bar 41. At its front, the round bar 41 curves upwardly at portion 42 for connecting to flat bracket 43. The bracket 43 is used to attach the hanger 40 to the saddle S shown in FIG. 6. The bracket 43 includes a plurality of openings 44 and 45 through which screws or other connecting means are used to connect it to the saddle S.

The bar 41 curves upwardly at its rear end at portion 48 to where it is connected to another flat bracket 49 which is identical to the bracket 43. The bracket 49 includes a plurality of openings 50, 51 and is connected to saddle S as shown in FIG. 5 by conventional means such as screws. The brackets 43 and 49 are flat plates like shown in FIG. 2.

Again referring to FIG. 5, there is shown a second generally horizontal bar 54 which is connected to the vertically extending portions 42 and 48 of the first horizontal bar 41 and the brackets 43 and 49. Slidably mounted to the bar 54 are a plurality of pins 55, 56 and 57. Each of the pins includes an opening and a curved recessed notch like those shown in FIG. 4. The bar 54 extends through the opening and the bar 41 fits closely to an inwardly recessed notch like shown in FIG. 4. This retains the pins in contact with the bar 41 and allows them to be slidably positioned along bar 54 and bar 41 to a desired position. Pins 55, 56 and 57 are identical to the pins 25-29 shown in FIG. 1.

The hanger 40 is generally the same as the hanger 10 but also includes an intermediate upwardly extending fixed pin 58 which is welded at its lower end to bar 41. An opening in the pin 58 receives the bar 54. A bracket 59 having a screw opening 60 is welded to the upper end of the fixed pin 58.

In use, a conventional rigging strap like the rigging strap 63 is secured to the front fixed portion 61 as is well known in the art and after its end is run down to a conventional girth ring R on girth G, which is shown in FIG. 6, the portion 64 is run back up to the bar 41 to a selected spot along rear fixed portion 62 between upward turned portion 48 and fixed pin 58. This allows the position of the saddle S to be adjusted on the horse. To selectively move the saddle forward, the rigging strap 63 after connecting to a girth ring is extended upwardly and looped over the portion 62 at one of the four selected positions determined by the locations of the slidable pins 55, 56 and 57 along the rear fixed space. FIG. 6 of the invention shows a conventional saddle with the hanger 40 connected thereto. When it is desired to change the position of a conventional rigging strap 63, it is only necessary to remove the end of the rigging strap 63 from rear portion 62 on bar 41. Pins 55, 56 and 57 are then slidably positioned at a desired location along the generally horizontal bars 41 and 54 along rear portion 62. The rigging strap 63 is then re-inserted in position over bar 41 at a selected location along rear portion 62. This provides four positions for longitudinally adjusting rigging strap 63 relative to saddle S. The closer the rigging strap 63 is positioned to portion 48, the further forward the saddle is positioned on a horse.

The rigging strap 63 is rigidly held in place and cannot slide along bar 62. This retains rigging strap 63 in a selected position. The hanger 40 is also typically constructed of metal material so that it is strong relative to the leather and saddle tree.

Although the present invention has been described in terms of the foregoing preferred embodiments, such embodiments are merely exemplary of the present invention. As will be apparent to those of ordinary skill in the art, many other alternatives, equivalents, modifications, objects, substitutions, variations and the like, of varying degrees, will fall within the scope of the present invention. For instance, the number, specifications and locations of various components or the sequence, number, and complexity of various steps can generally be modified to some degree while still serving substantially the same purposes of the present invention. Accordingly, nothing in the foregoing detailed descriptions limits the scope of the present invention in any respect, but rather that scope is defined instead only by the claims which follow, construed as broadly as possible.

I claim:

1. An apparatus for adjusting the position of the stirrup leathers and fenders or rigging straps on a riding saddle, comprising:

a saddle tree having hanger means for adjustably receiving a stirrup leather or rigging strap;

said hanger means having a first generally horizontal bar extending longitudinally along the saddle tree from front to back for receiving the stirrup leather or rigging strap;

said hanger means further having a second generally horizontal bar slidably mounting at least three adjusting pins;

said at least three adjusting pins slidably engaging said first horizontal bar whereby a stirrup leather or rigging strap can be selectably positioned and retained at a selected longitudinal position relative to the saddle tree.

2. The apparatus of claim 1, wherein:

the adjusting pins have openings at their upper ends slidably receiving the second generally horizontal bar.

3. The apparatus of claim 1, wherein:

the adjusting pins have retaining means at their lower ends slidably retaining them with the first generally horizontal bar.

4. The apparatus of claim 1, wherein:

the hanger means having attaching it means at its upper edge attaching to the saddle tree.

5. An method for adjusting the position of the stirrup leathers or rigging straps on a saddle tree having hanger means for adjustably receiving a stirrup leather or rigging strap, comprising the steps of:

positioning a stirrup leather or rigging strap on a first generally horizontal bar of a saddle tree hanger means extending longitudinally along the saddle tree from front to back for receiving the stirrup leather or rigging strap;

slidably positioning at least three adjusting pins on a second horizontal bar on said hanger means while retaining the pins in contact with the first horizontal bar whereby the stirrup leather or rigging strap can be selectably positioned and retained at a selected longitudinal position relative to the saddle tree.

6. The method of claim 5, wherein:

positioning the stirrup leather or rigging strap between at least two of the sliding pins to selectably position and retain the stirrup leather or rigging strap at a selected longitudinal position relative to the saddle tree.

* * * * *